US010273104B2

(12) United States Patent
Sato

(10) Patent No.: US 10,273,104 B2
(45) Date of Patent: Apr. 30, 2019

(54) IMAGE FORMING APPARATUS

(71) Applicant: BROTHER KOGYO KABUSHIKI KAISHA, Nagoya-shi, Aichi-ken (JP)

(72) Inventor: Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/873,545

(22) Filed: Jan. 17, 2018

(65) Prior Publication Data

US 2018/0141770 A1 May 24, 2018

Related U.S. Application Data

(63) Continuation of application No. 15/423,264, filed on Feb. 2, 2017, now Pat. No. 9,873,581, which is a (Continued)

(30) Foreign Application Priority Data

Oct. 17, 2014 (JP) ..... 2014-212906

(51) Int. Cl.

| | |
|---|---|
| ***B65H 15/00*** | (2006.01) |
| ***B65H 7/00*** | (2006.01) |
| ***B65H 5/06*** | (2006.01) |
| ***B65H 29/12*** | (2006.01) |
| ***B65H 85/00*** | (2006.01) |
| ***B65H 5/38*** | (2006.01) |

(52) U.S. Cl.

CPC ..... *B65H 15/00* (2013.01); *B65H 5/062* (2013.01); *B65H 5/38* (2013.01); *B65H 7/00* (2013.01); *B65H 29/125* (2013.01); *B65H 85/00* (2013.01); *B65H 2301/3121* (2013.01); *B65H 2301/33312* (2013.01); *B65H 2402/441* (2013.01); *B65H 2402/45* (2013.01); *B65H 2404/6111* (2013.01);

(Continued)

(58) Field of Classification Search

CPC ..... B65H 15/00; B65H 29/125; B65H 29/58; B65H 85/00

USPC ..... 271/291, 301, 65, 186

See application file for complete search history.

(56) References Cited

U.S. PATENT DOCUMENTS

| | | | |
|---|---|---|---|
| 5,337,134 | A | 8/1994 | Sato et al. |
| 9,561,925 | B2 | 2/2017 | Sato |

(Continued)

FOREIGN PATENT DOCUMENTS

| | | | |
|---|---|---|---|
| JP | 11-35210 | A | 2/1999 |
| JP | 2001117291 | A | 4/2001 |

(Continued)

*Primary Examiner* — David H Bollinger

(74) *Attorney, Agent, or Firm* — Merchant & Gould P.C.

(57) ABSTRACT

An image forming apparatus, including a main chassis having a discharge tray and a switchback tray in an upper position with respect to the discharge tray; an image forming unit; a discharge roller to discharge a recording sheet conveyed through the image forming unit onto the discharge tray; a duplex conveyer to invert the sheet and convey the inverted sheet to return to the image forming unit; and a switchback roller being rotatable in a normal direction to convey the sheet toward the switchback tray and a reverse direction to convey the sheet to the duplex conveyer; is provided. The main chassis includes a pair of walls, each of which extends in a vertical direction and in a conveying direction of the sheet and is arranged in adjacent to the switchback tray such that the switchback tray is interposed between the pair of walls.

11 Claims, 9 Drawing Sheets

Related U.S. Application Data continuation of application No. 14/884,069, filed on Oct. 15, 2015, now Pat. No. 9,561,925.

(52) U.S. Cl.

CPC .... *B65H 2404/63* (2013.01); *B65H 2404/693* (2013.01); *B65H 2601/11* (2013.01); *B65H 2601/324* (2013.01); *B65H 2801/06* (2013.01)

(56) References Cited

U.S. PATENT DOCUMENTS

| | | | |
|---|---|---|---|
| 2003/0063935 | A1 | 4/2003 | Seo |
| 2006/0209154 | A1 | 9/2006 | Okabe et al. |
| 2010/0284722 | A1 | 11/2010 | Kitayama |
| 2013/0071166 | A1 | 3/2013 | Mori |
| 2013/0301089 | A1 | 11/2013 | Arikawa |
| 2014/0064814 | A1 | 3/2014 | Sato |
| 2014/0183811 | A1 | 7/2014 | Takenaka |
| 2015/0130127 | A1 | 5/2015 | Saito |
| 2015/0145203 | A1 | 5/2015 | Kobayashi |
| 2015/0241832 | A1 | 8/2015 | Haruyama |
| 2015/0274473 | A1 | 10/2015 | Miwa et al. |

FOREIGN PATENT DOCUMENTS

| | | | |
|---|---|---|---|
| JP | 2003118914 | A | 4/2003 |
| JP | 2006089203 | A | 4/2006 |
| JP | 2006256827 | A | 9/2006 |
| JP | 2010260687 | A | 11/2010 |
| JP | 2013-063844 | A | 4/2013 |
| JP | 2014-048315 | A | 3/2014 |

IMAGE FORMING APPARATUS

CROSS REFERENCE TO RELATED APPLICATION

This application is a continuation of U.S. patent application Ser. No. 15/423,264, filed Feb. 2, 2017, which is a continuation of U.S. patent application Ser. No. 14/884,069, filed Oct. 15, 2015, and further claims priority under 35 U.S.C. § 119 from Japanese Patent Application No. 2014-212906, filed on Oct. 17, 2014. The entire subject matter of all applications are incorporated herein by reference.

BACKGROUND

Technical Field

An aspect of the present invention relates to an image forming apparatus having a duplex conveyer, which may invert a recording sheet having been conveyed through an image forming unit and return the recording sheet once again to the image forming unit.

Related Art

An image forming apparatus having a discharge tray, on which a recording sheet with an image formed thereon may be supported, is known. The image forming apparatus may further have a discharge roller to convey the recording sheet to the discharge tray, a switchback roller which is provided independently from the discharge roller to switchback the recording sheet, and a switchback tray, on which the recording sheet is supported while the recording sheet is switched back.

SUMMARY

The tray to support the recording sheet during the switchback may be formed in a shape of a plain board, and the recording sheet being supported thereon may move in a widthwise direction of the recording sheet during the switchback; therefore the recording sheet may not be switched back stably on the switchback tray. The instability of the recording sheet during the switchback may be worsened when, for example, the recording sheet is in a larger size, such as A3 or tabloid, which has a greater length.

The present disclosure is advantageous in that an image forming apparatus, which has a discharge roller and a switchback roller and is capable of switching back a recording sheet stably by the switchback roller, is provided.

According to an aspect of the present invention, an image forming apparatus, including a main chassis with a discharge tray and a switchback tray disposed in an upper position with respect to the discharge tray; an image forming unit configured to form an image on a recording sheet; a discharge roller configured to discharge the recording sheet conveyed through the image forming unit onto the discharge tray; a duplex conveyer configured to invert the recording sheet conveyed through the image forming unit and convey the inverted recording sheet to return the image forming unit; and a switchback roller configured to be rotatable in a normal direction and a reverse direction, the switchback roller being configured to convey the recording sheet conveyed through the image forming unit toward the switchback tray by rotating in the normal direction and to convey the recording sheet being conveyed toward the switchback tray to the duplex conveyer by rotating in the reverse direction, is provided. The main chassis includes a pair of walls, each of which extends in a vertical direction and in a conveying direction being a direction to convey the recording sheet by the switchback roller rotating in the normal direction toward the switchback tray, the pair of walls being arranged in adjacent to the switchback tray such that the switchback tray is interposed between the pair of walls.

BRIEF DESCRIPTION OF THE ACCOMPANYING DRAWINGS

DETAILED DESCRIPTION

Hereinafter, an exemplary configuration of an image forming apparatus according to an embodiment of the present invention will be described with reference to the accompanying drawings. First, an overall configuration of an MFD 1 according to the embodiment will be described, and later, detailed configuration of the MFD 1 will be described.

Figure 1:
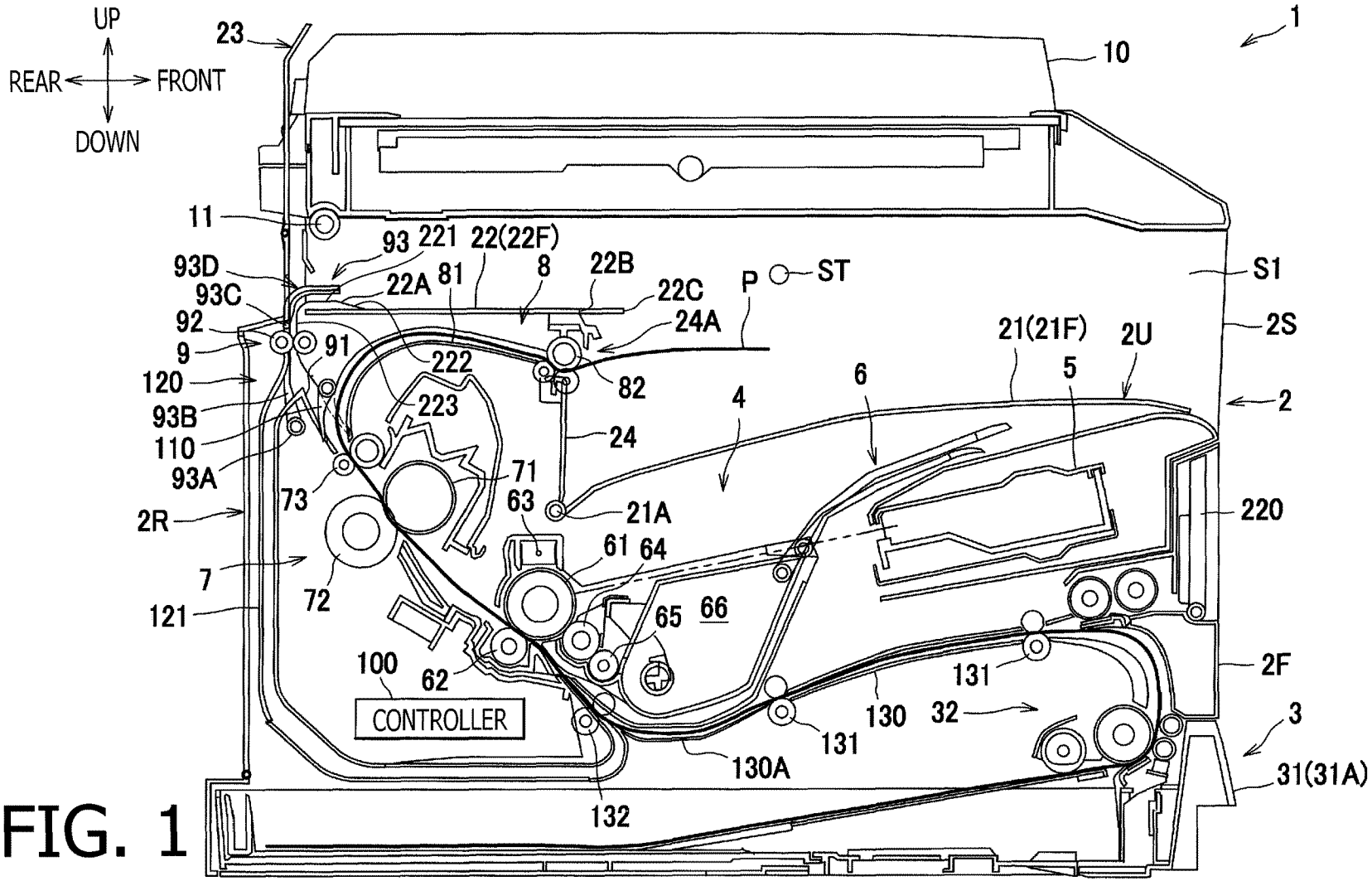
FIG. 1 is an illustrative cross-sectional side view of a multifunction peripheral device (MFP) according to an exemplary embodiment of the present disclosure.

In the following description, directions concerning the MFD 1 will be mentioned with regard to a user's ordinary position to use the MFD 1, as indicated by arrows in each drawing. For example, a viewer's right-hand side appearing in FIG. 1 is referred to as a front side of the MFD 1, and a left-hand side in FIG. 1 opposite from the front side is referred to as a rear side. A side which corresponds to the viewer's nearer side is referred to as a left-hand side for the user, and an opposite side from the left, which corresponds to the viewer's farther side is referred to as a right-hand side for the user. An up-down direction in FIG. 1 corresponds to a vertical direction of the MFD 1. Further, the right-to-left or left-to-right direction of the MFD 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-9 are similarly based on the orientation of the MFD 1 as defined above and correspond to those with regard to the MFD 1 shown in FIG. 1 even when the MFD 1 is viewed from different angles.

[Overall Configuration of the MFD]

As shown in FIG. 1, the MFD 1 includes a main chassis 2 and a reader unit 10. The MFD 1 further includes an image forming unit 4 to form an image on a sheet P being fed and a feeder unit 3 to feed the sheet P to the image forming unit 4, which are contained in the main chassis 2. The main chassis 3 includes paths, such as a conveyer path 130, a first discharge path 81, a second discharge path 91, and a duplex conveyer path 121, in which the sheet P may be conveyed. These paths may include members and/or parts that form the paths.

The main chassis 2 includes a front wall 2F, a rear wall 2R, an upper wall 2U, and a pair of lateral frames 2S that are disposed on a leftward side and a rightward side of the upper wall 2U. The upper wall 2U includes a front part and a rear part. The front part of the upper wall 2U includes a discharge tray 21, which includes a placement surface 21F to support the sheet P from below. The rear part of the upper wall 2U includes a switchback tray 22, which includes a placement surface 22F to support the sheet P from below. The discharge tray 21 and the switchback tray 22 are arranged in different vertical levels, and the switchback tray 22 is disposed in an upper position with respect to the discharge tray 21. An upper part of the rear wall 2R includes an upper discharge tray 23, which supports the sheet P from behind. Detailed configuration of the main chassis 2 will be described later.

The reader unit 10 may be a flatbed scanner having a known configuration. The reader unit 10 may cast light onto an original sheet (not shown) and read an image of the original sheet to generate image data, which may be used to make a duplicate of the read image. The reader unit 10 may be disposed in an upper position with respect to the switchback tray 22 so that space may be formed between the switchback tray 22 and the reader unit 10, and widthwise ends of the reader unit 10 may be supported sideward by the lateral frames 2S (see FIG. 6).

Figure 2:
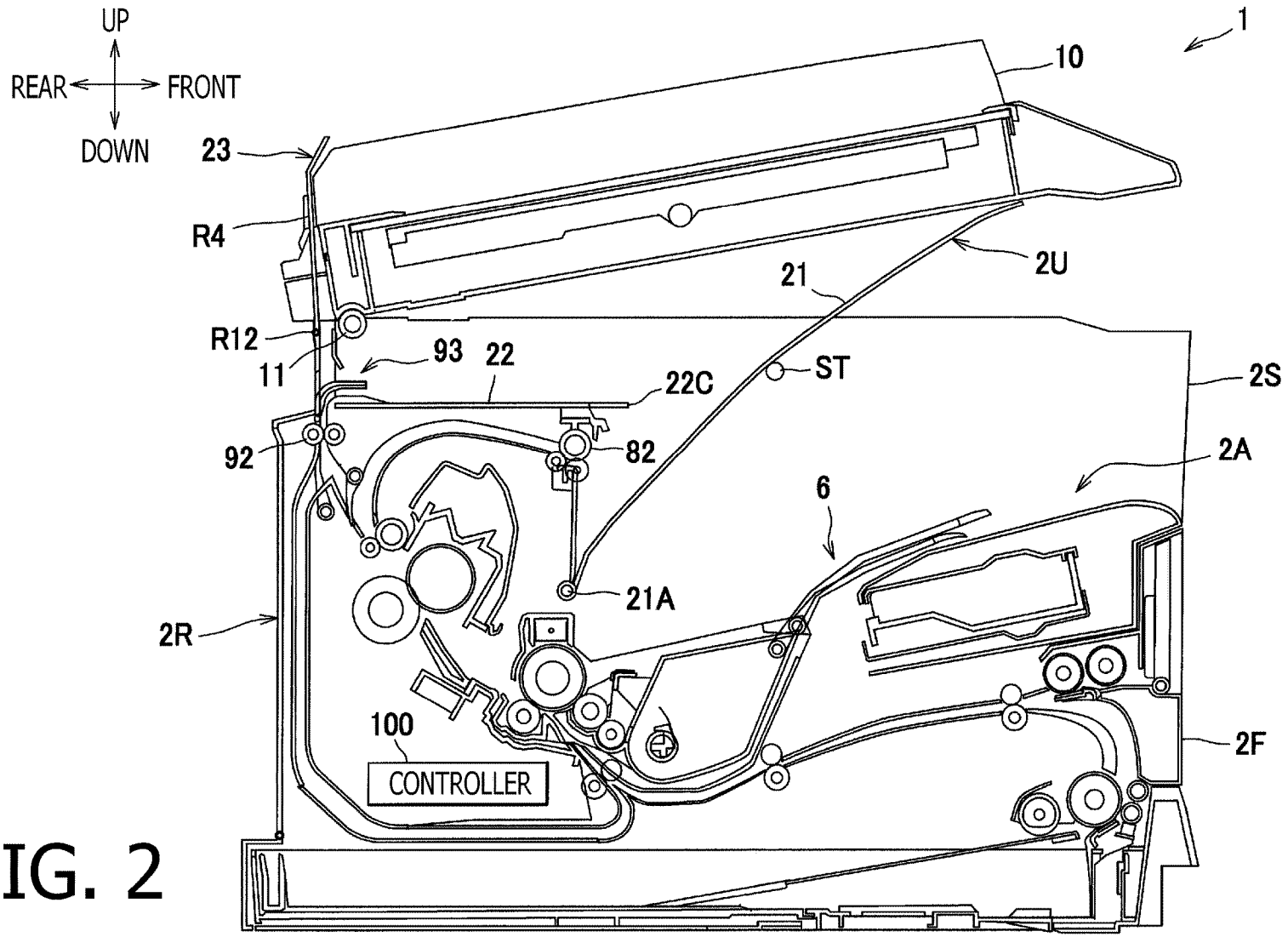
FIG. 2 is a cross-sectional side view of the MFD according to the exemplary embodiment of the present disclosure with a reader unit and a discharge tray being uplifted.

For example, the reader unit 10 may be supported pivotably by the lateral frames 2S at a rear end thereof through a pivot shaft 11 so that a front part of the reader unit 10 may pivot about the pivot shaft 11 vertically (see FIG. 2). Meanwhile, the lateral frames 2S may have a stopper ST, which is resilient and engageable with the discharge tray 21 when the reader unit 10 pivots upward, to hold the discharge tray 21, so that the reader unit 10 pivoted upward may be supported by the stopper ST through the discharge tray 21 and held steadily at the upper position.

The feeder unit 3 is disposed in a lower position in the main chassis 2 and includes a feeder tray 31, in which the sheets P to be fed are placed, and a feeding system 32 to feed the sheets P in the feeder tray 31 are fed to the image forming unit 4 one by one. The feeder tray 31 is detachably attached to the main chassis 2 and includes a feeder tray 31A (see FIG. 1), in which sheets P having a length smaller than or equal to a predetermined length, such as A4-sized sheets or letter-sized sheets, may be stored, and a larger feeder tray 31B (see FIG. 4), in which sheets P having a length greater than the predetermined length, such as A3-sized sheets or tabloid-sized sheets, may be stored. In other words, the feeder trays 31A, 31B for different-sized sheets P may be attached to the main chassis 2.

The image forming unit 4 includes a scanner unit 5, a processing cartridge 6, and a fixing unit 7.

The scanner unit 5 is disposed in a frontward position in the main chassis 2 and includes a laser emitter, polygon mirrors, lenses, and reflection mirrors, which are not shown. In the scanner unit 5, a laser beam may be emitted at a surface of a photosensitive drum 61 in the processing cartridge 6 to scan the surface of the photosensitive drum 61.

The processing cartridge 6 is disposed in a rearward position with respect to the scanner unit 5 and includes the photosensitive drum 61, a transfer roller 62, a charger 63, a developer roller 64, a supplier roller 65, and a toner container 66.

In the processing cartridge 6, while the photosensitive drum 61 rotates, the surface of the photosensitive drum 61 is electrically charged by the charger 63 evenly and exposed partly to the laser beam emitted from the scanner unit 5 so that electrical charges of the exposed areas are lowered and a latent image according to image data is formed to be carried on the surface of the photosensitive drum 51.

Meanwhile, the toner in toner container 66 is supplied to the latent image on the photosensitive drum 61 through the developer roller 64 while the developer roller 64 rotates so that the latent image on the photosensitive drum 61 is developed to be a toner image. In the meantime, as the sheet P is conveyed by the feeding system 32 and by a plurality of conveyer roller pairs 131 in the conveyer path 130, from a lower position with respect to the scanner unit 5, through a lowest position 130A, which is in a lower position with respect to the toner container 66, and through a registration roller pair 132, to a position between the photosensitive drum 61 and the transfer roller 62. As the sheet P is conveyed through the position between the photosensitive drum 61 and the transfer roller 62, the toner image carried on the surface of the photosensitive drum 61 is transferred onto the sheet P.

The fixing unit 7 is disposed in an upper-rearward position with respect to the processing cartridge 6 and includes a heat roller 71, a pressure roller 72, and a conveyer roller 73. In the fixing unit 7, the toner image transferred to the sheet S is thermally fixed thereon as the sheet S is conveyed through a position between the heat roller 71 and the pressure roller 72. The sheet P with the thermally-fixed image is discharged by the conveyer roller 73 out of the fixing unit 7.

In positions on a downstream side of the fixing unit 7 with regard to a conveying direction to convey the sheet P, disposed are a first discharge unit 8, which may discharge the sheet P conveyed through the image forming unit 4, more specifically the fixing unit 7, to the discharge tray 21, and a second discharge unit 9, which may convey the sheet P conveyed through the image forming unit 4, more specifically the fixing unit 7, to either the switchback tray 22 or the upper discharge tray 23.

The first discharge unit 8 includes the first discharge path 81, a discharge roller 82, a first outlet 24A, and the discharge tray 21. The first discharge path 81 is formed to extend upward from the conveyer roller 73 and to curve frontward. The discharge roller 82 conveys the sheet P in the first discharge path 81 to discharge through the first outlet 24A onto the discharge tray 21. The discharge roller 82 is controlled by a controller 100 to rotate in a normal direction, which is a direction to convey and discharge the sheet P outward through the first outlet 24A.

The second discharge unit 9 includes the second discharge path 91, a switchback roller 92, an L-shaped guide 93, the switchback tray 22, and the upper discharge tray 23. The second discharge path 91 is formed to extend substantially linearly upper-rearward from the conveyer roller 73. Therefore, a minimum radius of curvature in the second discharge path 91 is greater than a minimum radius of curvature in the first discharge path 81.

The switchback roller 92 includes paired rollers which are arranged to face with each other along the front-rear direction. The switchback roller 92 is rotatable in a normal direction, which is a direction to convey the sheet P outward to the switchback tray 22 or the upper discharge tray 23, and in a reverse direction, which is an opposite direction from the normal direction. In other words, the switchback roller 92 is rotatable to convey the sheet P in the second discharge path 91 upward and downward. The switchback roller 92 is disposed in a rearward and spaced-apart position from the discharge roller 82. In other words, the discharge roller 82 is in a frontward position with respect to the switchback roller 92. Thus, the discharge roller 82 is disposed on a frontward side of the switchback tray 22, and the switchback roller 92 is disposed on another side, on a rearward side, of the switchback tray 22 opposite from the discharge roller 82.

The L-shaped guide 93 is a guide member including a guiding parts 93, a part of which may be placed between the switchback roller 92 and the switchback tray 22, to guide the sheet P conveyed upward by the switchback roller 92 toward the switchback tray 22. The L-shaped guide 93 is supported pivotably by the main chassis 2, or more specifically, by the lateral frames 2S. The L-shaped guide 93 is pivotable between a guiding position (see FIG. 1), in which the L-shaped guide 93 may guide the sheet P toward the switchback tray 22, and a non-guiding position (indicated by solid lines in FIG. 5A), in which the sheet P may be conveyed to the upper discharge tray 23.

More specifically, when the L-shaped guide 93 is in the guiding position, the L-shaped guide 93 may contact the sheet P being conveyed upward by the switchback roller 92 and guide the sheet P to be conveyed toward the switchback tray 22. When the L-shaped guide 93 is in the non-guiding position, the L-shaped guide 93 does not interfere with the sheet P being conveyed upward by the switchback roller 92 so that the sheet P is allowed to be conveyed toward the upper discharge tray 23. Thus, by switching the positions of the L-shaped guide 93 between the guiding position and the non-guiding position, courses of the sheet P may be switched between a course to the switchback tray 22 and a course to the upper discharge tray 23. The L-shaped guide 93 will be described later in detail.

A switch member 110 to switch the courses for the sheet P is disposed in a position between the first discharge path 81 and the second discharge path 91. The switch member 110 is swingably supported by the main chassis 2, or more specifically, the lateral frames 2S. The switch member 110 may swing between a first guiding position, which is indicated by solid lines in FIG. 1, and a second guiding position, which is indicated by broken lines in FIG. 1. In the first guiding position, the switch member 110 may guide the sheet P to the first discharge path 81. In the second guiding position, the switch may guide the sheet P to the second discharge path 91.

On a rear side of the main chassis 2, disposed is a duplex conveyer 120, which may invert the sheet P conveyed through the image forming unit 4 and convey the inverted sheet P once again to the image forming unit 4. The duplex conveyer 120 includes the switchback roller 92, the L-shaped guide 93, the switchback tray 22, the upper discharge tray 23, and the duplex conveyer path 121, which are mentioned earlier. The duplex conveyer path 121 is formed to extend from the second discharge path 91 to one of the registration roller pairs 130, which is at a frontward position with respect to a nipping position between the photosensitive drum 61 and the transfer roller 62. The duplex conveyer path 121 extends from the second discharge path 91 downward along a rear side of the fixing unit 7, curves frontward along a lower side of the fixing unit 7 and the photosensitive drum 61, and curves upper-rearward toward the nipping position between the photosensitive drum 61 and the transfer roller 62.

The controller 100 includes a central processing unit (CPU), a random-access memory (RAM), a read-only memory (ROM), and input/output (I/O) circuits, which are not shown, and controls behaviors of each part and component in the MFD 1, including the first discharge unit 8, the second discharge unit 9, and the duplex conveyer 120. For example, the controller 100 may control the switch member 110 and the L-shaped guide 93 to switch positions thereof and may control rotations of the rollers including the discharge roller 82 and the switchback roller 92. The controller 100 may perform a switchback control, in which the rotating directions of the switchback roller 92 may be switched while the switchback roller 92 conveys the sheet P upward so that the sheet P may be switched back downward, and an output control, in which the switchback roller 92 may be maintained to rotate in the normal direction to convey the sheet P to either the switchback tray 22 or to the upper discharge tray 23.

Figure 4:
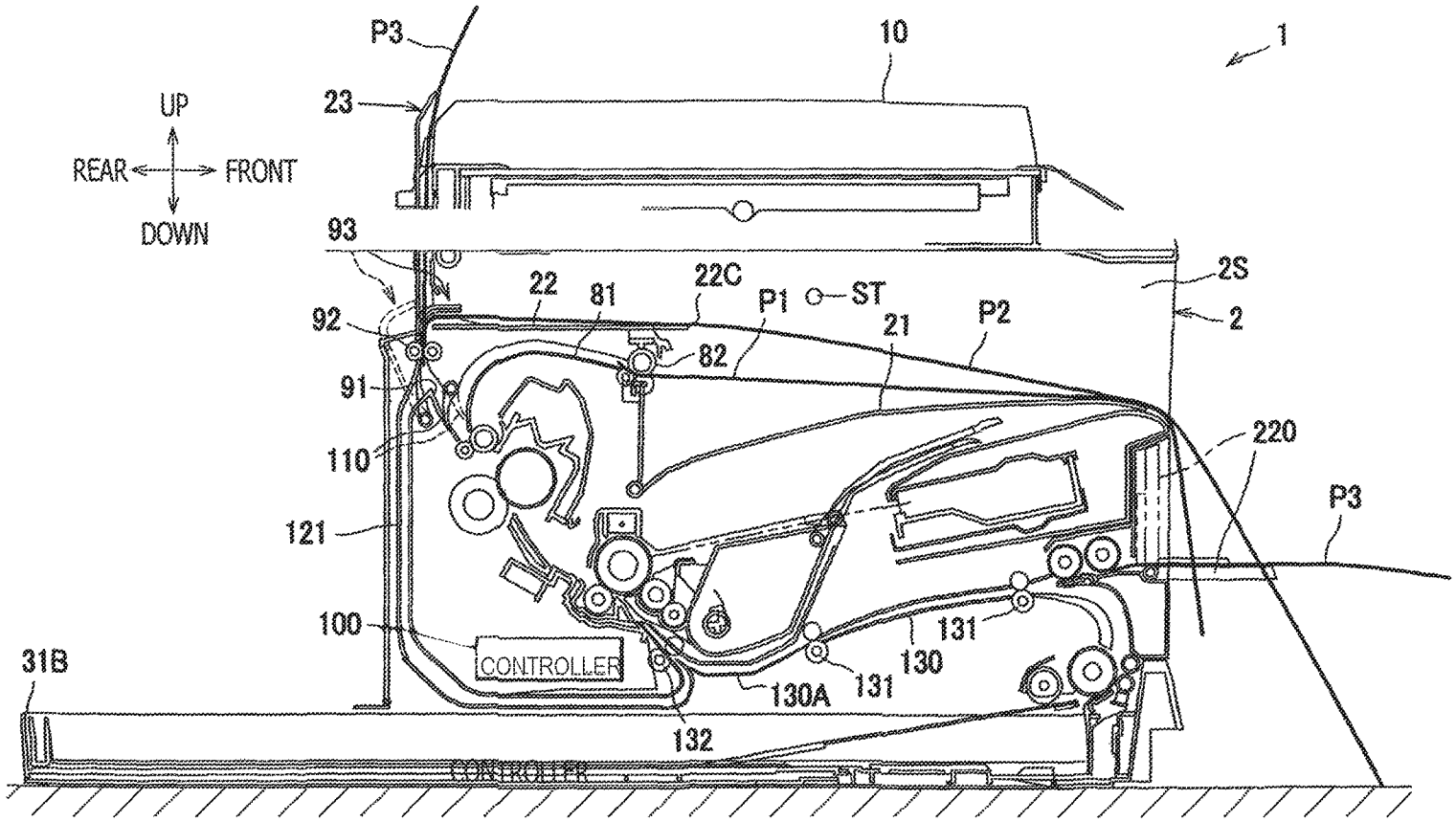
FIG. 4 is a cross-sectional side view of the MFD according to the exemplary embodiment of the present disclosure with a feeder tray for A4-sized sheets being attached to the main chassis.

For example, when the sheet P1 is to be discharged to the discharge tray 21, as shown in FIG. 4, the controller 100 may place the switch member 110 in the first guiding position, as indicated by the solid lines, and drive the discharge roller 82 to rotate in the normal direction, which is the direction to discharge the sheet P outward. For another example, when the sheet P is to be conveyed to the switchback tray 22, the controller 100 may place the switch member 110 in the second guiding position, as indicated by the broken lines; place the L-shaped guide 93 in the guiding position, as indicated by the solid lines; and drive the switchback roller 92 to rotate in the normal direction, which is the direction to discharge the sheet P outward.

In the MFD 1 according to the present embodiment, a sheet P2 having a greater length, such as an A3-sized sheet and a tabloid-sized sheet, may be preferably conveyed or discharged to the switchback tray 22, as shown in FIG. 4. The sheet P2 having the greater length may be preferably supported by the switchback tray 22 and the discharge tray 21.

Meanwhile, the controller 100 may place the switch member 110 in the second guiding position, as indicated by the broken lines in FIG. 4, and drive the switchback roller 92 to rotate in the normal direction, which is the direction to discharge the sheet P outward, when the sheet P3 is to be discharged to the upper discharge tray 23. Further, when the sheet P having an image printed on one side thereof is conveyed to return to the image forming unit 4, the controller 100 may place the switch member 110 in the second guiding position and the L-shaped guide 93 in either the guiding position or the non-guiding position, and drive the switchback roller 92 to rotate in the normal direction so that the sheet P may be conveyed once in the normal direction toward to the switchback tray 22 or the upper discharge tray 23, and thereafter, before the sheet P exits the switchback roller 92, the controller 100 may switch the rotating directions of the switchback roller 92 conveyed to drive the switchback roller 92 to rotate in the reverse direction.

[Configurations of the Main Chassis and the L-Shaped Guide]

Configurations of the main chassis 2 and the L-shaped guide 93 in the MFD 1 will be described below in detail. As shown in FIG. 1, the upper wall 2U of the main chassis 2 includes the discharge tray 21, the switchback tray 22, and a vertical wall 24 which is arranged between the discharge tray 21 and the switchback tray 22.

The discharge tray 21 is formed to extend from a lower end of the vertical wall 24 upper-frontward and has a length in the front-rear direction, which is greater than or equal to a length of the main chassis 2 in the front-rear direction. For example, the length of the discharge tray 21 in the front-rear direction may be ⅔ of the length of the main chassis 2 in the front-rear direction.

A rear end of the discharge tray 21 is swingably supported by the vertical wall 24 or the lateral frames 2S through a swing shaft 21A. Thereby, the discharge tray 21 is swingable between a closed position (see FIG. 1) and an open position (see FIG. 2). When the discharge tray 21 is in the open position, an opening 2A (see FIGS. 2 and 3), through which the processing cartridge 6 may be attached to or detached from the main chassis 2, may be exposed.

The vertical wall 24 is supported by the lateral frames 2S at widthwise ends thereof. In a position above the vertical wall 24, formed is the first outlet 24A, through which the sheet P is discharged out of the main chassis 2 (see also FIG. 6).

The switchback tray 22 is arranged in an upper position with respect to the discharge tray 21 to extend from an upper end of the vertical wall 24 rearward and substantially horizontally. The switchback tray 22 has a length in the front-rear direction, which is less than a half of the length of the main chassis 2 in the front-rear direction. For example, the length of the switchback tray 22 in the front-rear direction may be ⅓ of the length of the main chassis 2 in the front-rear direction. The switchback tray 22 is supported by the lateral frames 2S at widthwise ends thereof.

Figure 9:
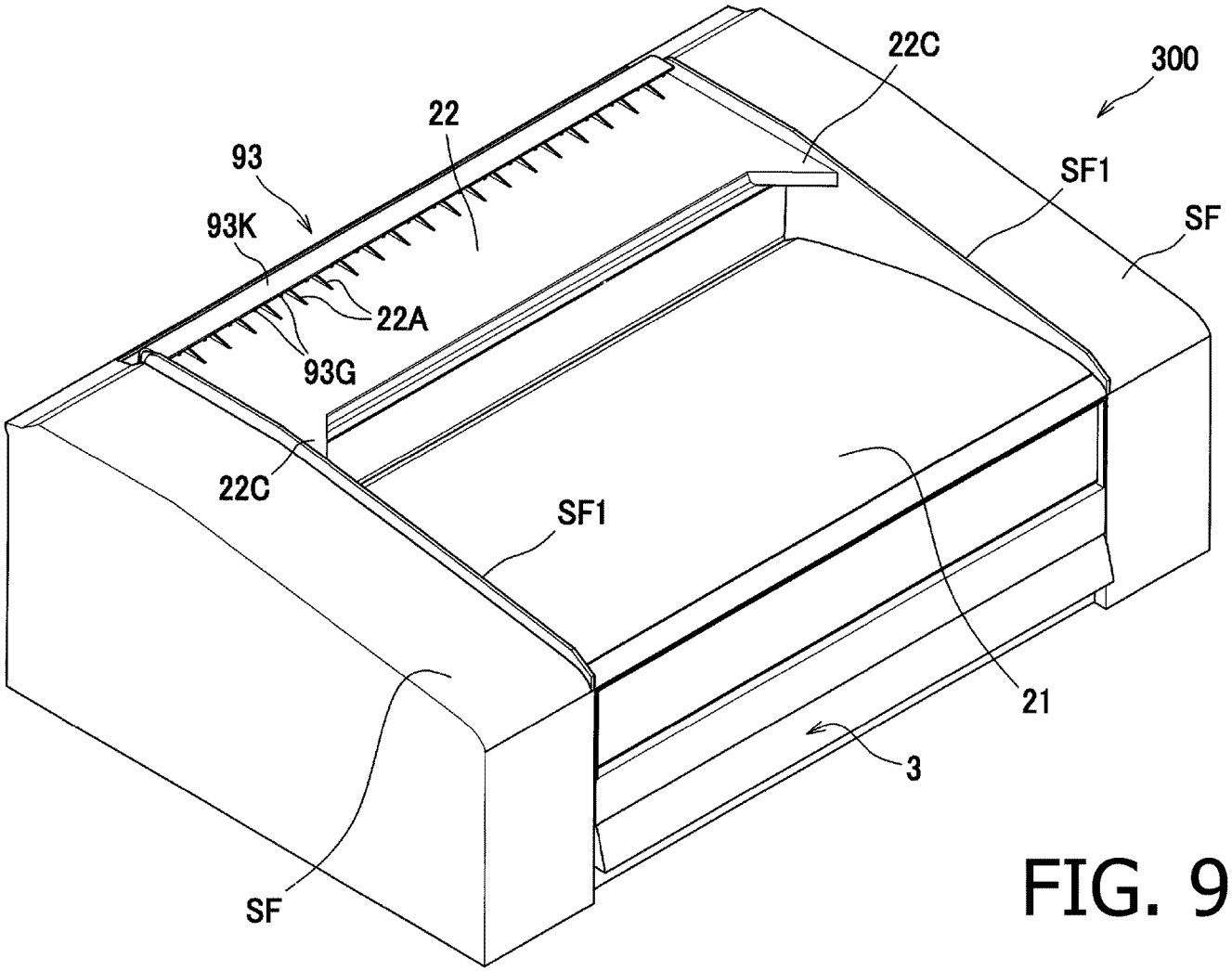
FIG. 9 is a perspective view of the modified example of the MFD according to the exemplary embodiment of the present disclosure.

On a front edge 22B of the switchback tray 22, arranged is a second rib 22C, which protrudes frontward from the front edge 22B, in a position to overlap the discharge tray 21 in a vertical view. The second rib 22C is formed at each end of the switchback tray 22 along the widthwise direction, which is an axial direction of the discharge roller 82. Each second rib 22C is formed in a triangular shape, in a plan view along the vertical direction, of which width along the widthwise direction reduces to be narrower outwardly as a corner of the triangle points frontward. For the shape and the arrangement of the second ribs 22C, FIG. 9 may be referred to. While FIG. 9 illustrate a perspective view of an MFD 300, which is a modified example of the MFD 1 of the present embodiment, the shape and the arrangement of the second ribs 22C may not necessarily be differed but may be similar or identical between the MFD 300 and the MFD 1.

With the second ribs 22C on the front edge of the switchback tray 22, even when the sheet P is left on the discharge tray 21, and when the longer sheet P, such as the A3-sized or tabloid-sized sheet P, is exposed partly on the switchback tray 22 during double-face printing, the sheet P on the switchback tray 22 may be supported by the second ribs 22 and may be prevented from interfering with the sheet P left on the discharge tray 21. Thus, the sheet P left on the discharge tray 21 may be prevented from moved by a frontend of the sheet P being conveyed or from falling off from the discharge tray 21.

The switchback tray 22 is formed to have a plurality of ribs 22A (see FIG. 6) on one end thereof on an upstream side with regard to the conveying direction, i.e., a rear end thereof, to support the sheet P. The ribs 22A are formed to protrude upward from an upper surface of the switchback tray 22. Each of the ribs 22A includes a first part 221, of which upper edge extends horizontally along the front-rear direction, a second part 222, which extends from a front end of the first part 221 to incline downward, and a third part 223, which extends from a rear end of the first part 222 to curve downward to reach the switchback roller 92 (see also FIG. 1).

With the ribs 22A on the switchback tray 22, the sheet P being switched back may be supported on the ribs 22A, and friction resistance may be reduced compared to the switchback tray 22 without the ribs 22A. In this regard, the switchback tray 22 may not necessarily keep the sheets P discharged out of the main chassis 2 thereon but may support the sheet P temporarily when the sheet P being conveyed during double-face printing is switched back to be drawn to the duplex conveyer path.

Each of the lateral frames 2S is formed in a shape of a rectangular box (see FIG. 6) and arranged to extend along the front-rear direction between a position in the vicinity of the front end of the discharge tray 21 and a position in the vicinity of the rear end of the switchback tray 22 and to stand upward to be higher than the placement surface 21F of the discharge tray 21 and the placement surface 22F of the switchback tray 22. More specifically, an upper end of each lateral frame 2S is in a position higher than the L-shaped guide 93. The protrusive parts of the lateral frames 2S that protrude to be higher than the placement surface 22F are arranged on both widthwise sides of the switchback tray 22 in adjacent to the switchback tray 22 sidewise, with the switchback tray 22 interposed in there-between, and extend in the conveying direction of the sheet P, in which the sheet P may be conveyed by the switchback roller 92 toward the switchback tray 22.

A protrusive height of the protrusive part in each lateral frame 2S to protrude from the placement surface 22F may be in a range between, for example, 10 mm and 100 mm or may be between 20 mm and 80 mm. A length of the protrusive part in the lateral frame 2S along the conveying direction in the lateral frame 2S may be in a range between 20 mm and 200 mm or may be between 40 mm and 160 mm.

A distance between inner surfaces S1 of the lateral frames 2S along the widthwise direction at the protrusive parts higher than the discharge tray 21 and the switchback tray 22 may be substantially greater than a width of the sheet P, in particular the sheet P in a largest size usable in the MFD 1. Thus, widthwise ends of the sheet P being discharged on the discharge tray 21 or the switchback tray 22 may be restricted from skewing and falling off sideward by the inner surfaces S1 of the lateral frames 2S.

The inner surfaces S1 of the lateral frames 2S overlap the L-shaped guide 93 in a lateral view along an axial direction of the switchback roller 92. Therefore, while a surface of the sheet P is guided by the L-shaped guide 93, the widthwise ends of the sheet P are guided by the inner surfaces S1.

Figure 7A:
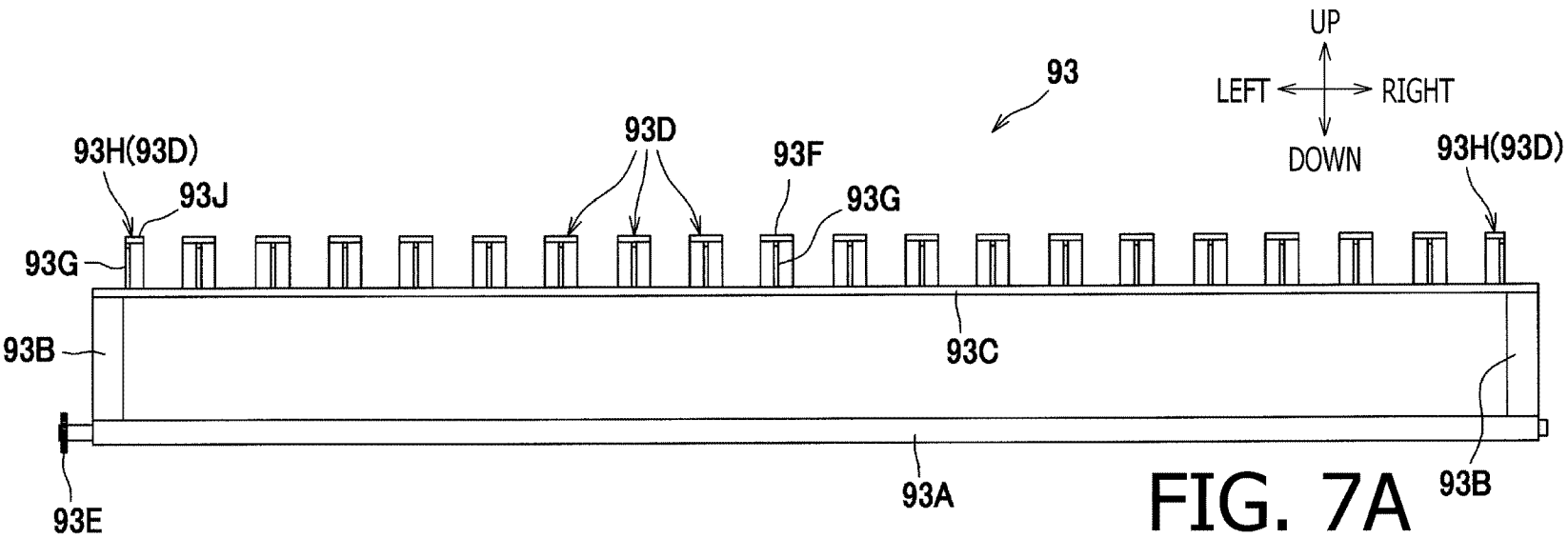
FIG. 7A is a front view of an L-shaped guide for the MFD according to the exemplary embodiment of the present disclosure.
Figure 7B:
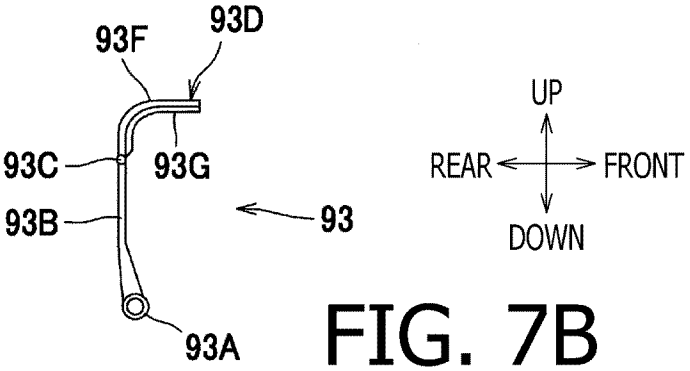
FIG. 7B is a side view of the L-shaped guide for the MFD according to the exemplary embodiment of the present disclosure.

As shown in FIGS. 7A and 7B, the L-shaped guide 93 includes a pivot shaft 93A, which axially extends along the widthwise direction, a pair of extended parts 93B, which extend upward in a radial direction of the pivot shaft 93A from axial ends of the pivot shaft 93A, a connector part 93C, which connects upper ends of the extended parts 93B with each other, and a comb-teeth section having a plurality of guiding parts 93D, which are arranged on the connector part 93C. In the following description, directions concerning the L-shaped guide 93 will be based on an orientation of the L-shaped guide 93 placed in the guiding position.

On one of the widthwise ends of the pivot shaft 93A, disposed is a driving gear 93E, through which driving force from a drive source (not shown) such as a motor is input to the pivot shaft 93A. Thereby, under the control of the controller 100, the positions of the L-shaped guide 93 may be switched between the guiding position and the non-guiding position. As shown in FIG. 1, the pivot shaft 93A is arranged in a lower position than an upper end of the duplex conveyer path 121 and is pivotably supported by the lateral frames 2S.

The extended parts 93B are arranged to protrude upward from the axial ends of the pivot shaft 93A to extend through widthwise outward positions with respect to widthwise ends of a rearward one of the paired rollers in the switchback roller 92 to upper positions with respect to the switchback roller 92. The connector part 93C is arranged in an upper position with respect to the rearward one of the paired rollers in the switchback roller 92.

Figures 5A, 5B:
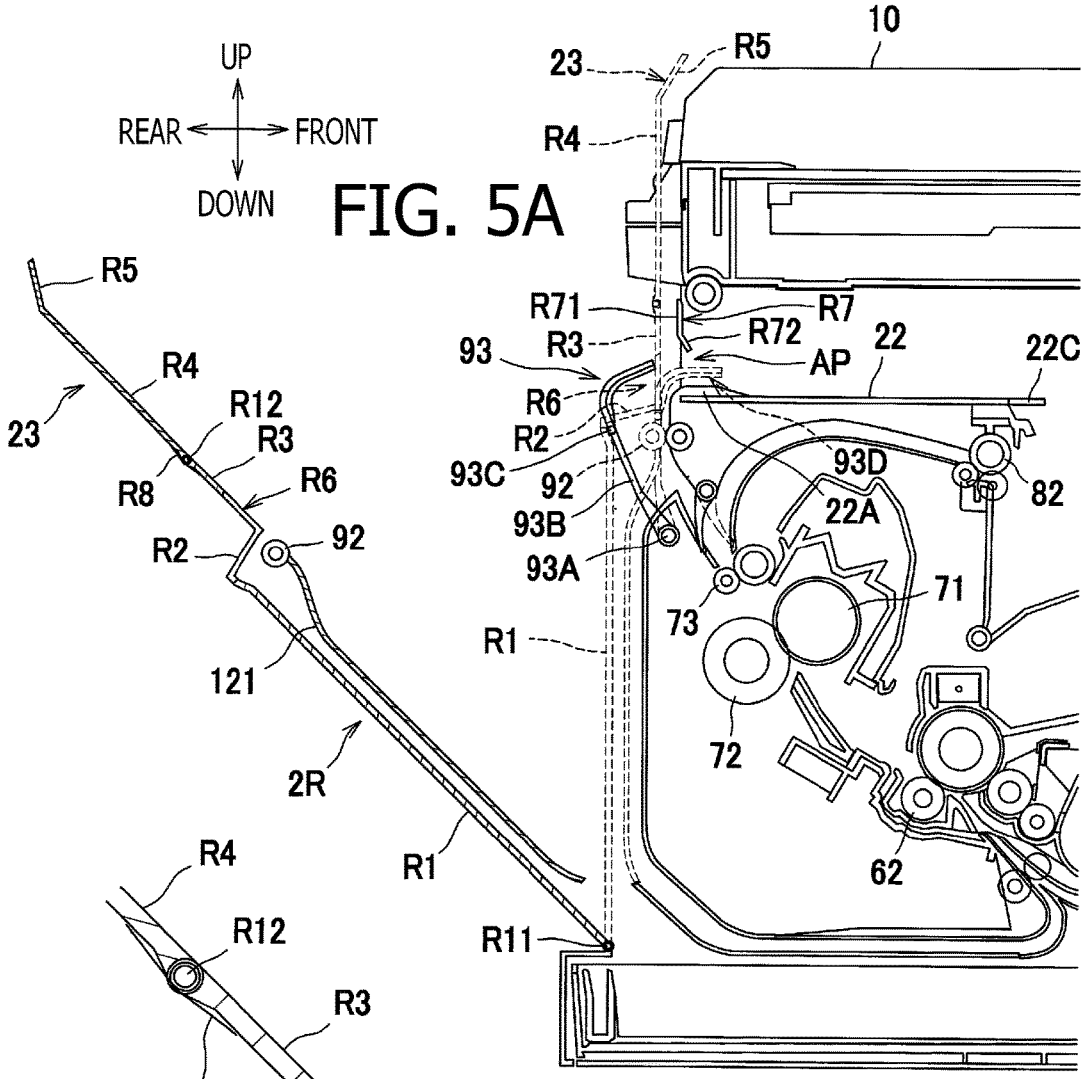
FIG. 5A is a partial view of the MFD according to the exemplary embodiment of the present disclosure with a rear wall being pivoted rearward.
FIG. 5B is an enlarged view of the rear wall of the MFD according to the exemplary embodiment of the present disclosure.

Thus, the pivot shaft 93A, the pair of extended parts 93B, and the connector part 93C form a rectangular frame, in a front view (see FIG. 5A). Thereby, the L-shaped guide 93 may be prevented from interfering with the switchback roller 92 and the duplex conveyer path 121 when pivoting between the guiding position and the non-guiding position. Further, when the sheet P is switched back to enter the duplex conveyer path 121, the sheet P may be conveyed through the frame formed by the pivot shaft 93A, the pair of extended parts 93B, and the connector part 93C without being interfered with by the L-shaped guide 93.

As shown in FIG. 7A, the guiding parts 93D are arranged to be spaced apart from one another along the widthwise direction on the connector part 93C in a comb-teeth arrangement. As shown in FIG. 7B, each of the guiding parts 93D include an outer shell 93F, which extends upward from the connector part 93C, curves frontward, and extends frontward; and a guide rib 93G, which is formed on an inner surface of the outer shell 93F to protrude inward.

As shown in FIG. 7A, among the plurality of guiding parts 93D, guiding parts 93H, which are in widthwise outmost positions, are each formed to have an outer shell 93J, of which width is smaller than a width of the outer shell 93F of the other guiding parts 93D, and a guide rib 93G, which is similar to the guide rib 93G of the other guiding parts 93D.

Figure 6:
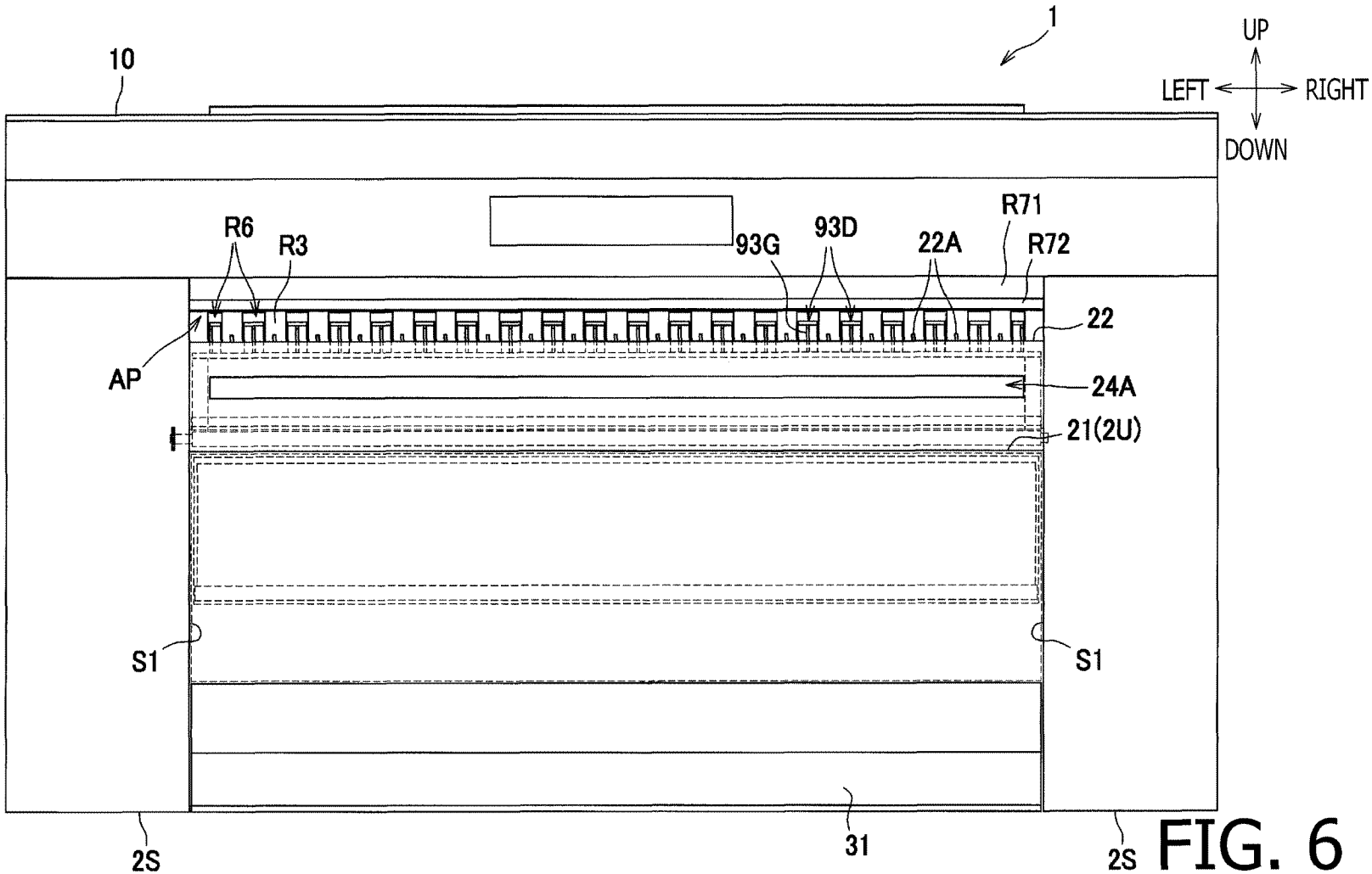
FIG. 6 is a front view of the MFD according to the exemplary embodiment of the present disclosure.

As shown in FIGS. 1 and 6, a frontward part of each guiding part 93D vertically overlaps the switchback tray 22 and is in an upper position with respect to the ribs 22A. Meanwhile, the guide ribs 93G are arranged in alternately displaced positions with respect to the ribs 22A in the widthwise direction. Thereby, the sheet P may be guided by the guide ribs 93G and the ribs 22A preferably on the switchback tray 22.

As shown in FIG. 5A, the rear wall 2R of the main chassis 2 is pivotable about a lower end thereof along with the rearward one of the paired rollers in the switchback roller 92 and a part of the duplex conveyer path 121. Therefore, by pivoting the rear wall 2R along with the rearward one of the paired roller in the switchback roller 92 and the part of the duplex conveyer path 121, the sheet P, which may be jammed at the switchback roller 92 or in the duplex conveyer path 121, may be exposed to be removed. In the following description, directions concerning the rear wall 2R will be based on an orientation of the rear wall 2R being in the closed position, which is indicated by broken lines in FIG. 5A.

The rear wall 2R includes a first rear wall R1 extending vertically, a second wall R2 extending frontward from the first wall R1, a third wall R3 extending upward from a front end of the second wall R2, a fourth wall R4 which is pivotable at an upper end of the third wall R3, and a fifth wall R5 extending upper-frontward from an upper end of the fourth wall R4.

The first wall R1 extends upward from a first pivot shaft R11, which is a pivot axis of the rear wall 2R. The second wall R2 extends from the upper end of the first wall R1 to an upper position with respect to the rearward one of the paired rollers in the switchback roller 92. The third wall R3 extends from the front end of the second wall R2 to a position in the vicinity of a bottom of the reader unit 10.

In a frontward position with respect to an upper portion of the third wall R3, disposed is a sheet guide R7, which may restrict the sheet P conveyed by the switchback roller 92 toward the upper discharge tray 23 from bending frontward toward the switchback tray 22. The sheet guide R7 is arranged in a position vertically between the reader unit 10 and the switchback tray 22 to connect the lateral frames 2S with each other. While the sheet guide R7 is arranged to be spaced apart vertically from the guiding parts 93D of the L-shaped guide 93, a clearance, or an aperture AP, is formed at a position between the sheet guide R7 and the switchback tray 22. In other words, the sheet guide R7 forms the aperture AP so that the air may flow through the aperture AP along the front-rear direction, which is an extending direction for the inner surfaces S1 of the lateral frames 2S. The sheet guide R7 includes a base part R71 extending vertically, a slanted part R72 extending lower-frontward from a lower end of the base part R71, and the aperture AP formed at a lower position with respect to the slanted part R72.

As shown in FIGS. 5A and 5B, the second wall R2 and the third wall R3 are formed to have a plurality of slits R6 (see also FIG. 6), which are formed along the front-rear direction through the rear wall 2R in positions spaced apart from one another along the widthwise direction. In the slits R6, the guiding parts 93D of the L-shaped guide 93 may be inserted when the L-shaped guide 93 is in the guiding position so that L-shaped guide 93 with the guiding parts 93D may be pivotable without being interfered with by the rear wall 2R.

The slits R6 are elongated vertically so that upper ends thereof are in upper positions with respect to the guiding parts 93D of the L-shaped guide 93 in the guiding position. Thereby, openings are formed in the position between the reader unit 10 and the main chassis 2 through the rear wall 2R along the front-rear direction. Therefore, when the air flows in the space between the reader unit 10 and the main chassis 2 through a position between the front end of the discharge tray 21 and the front end of the reader unit 10, the air may flow rearward and exit through the position between the switchback tray 22 and the reader unit 10, through the positions between the guiding parts 93D and the sheet guide R2, and through the slits R6.

The fourth wall R4 is connected with the upper end of the third wall R3 through the second pivot shaft R12. As shown in FIG. 2, when the frontward part of the reader unit 10 is uplifted, the rearward part of the reader unit 10 may interfere with the fourth wall R4. However, with the pivotable structure of the fourth wall R4, the fourth wall R4 may pivot about the second pivot shaft R12 to lean rearward, and load that may be applied to the rear wall 2R from the reader unit 10 may be reduced.

Referring back to FIGS. 5A and 5B, in a position between the fourth wall R4 and the third wall R3, arranged is a torsion spring R8, which may urge the fourth wall R4 and the third wall R3 to align straight (FIG. 5A). Thereby, the fourth wall R4, which is pressed by the reader unit 10 to pivot rearward (see FIG. 2), may recover to an original position by the urging force from the torsion spring R8 when the reader unit 10 is placed back to the original position (see FIG. 1).

Meanwhile, the upper discharge tray 23 is arranged to extend substantially vertically and includes the third wall R3, the fourth wall R4, and the fifth wall R5. In other words, the upper discharge tray 23 is in an upper position with respect to the rearward one of the paired roller in the switchback roller 92 to extend upward from the upper position with respect to the rearward one of the paired roller in the switchback roller 92, with an upper portion thereof, which is the fifth wall R5, leaning frontward.

Figure 3:
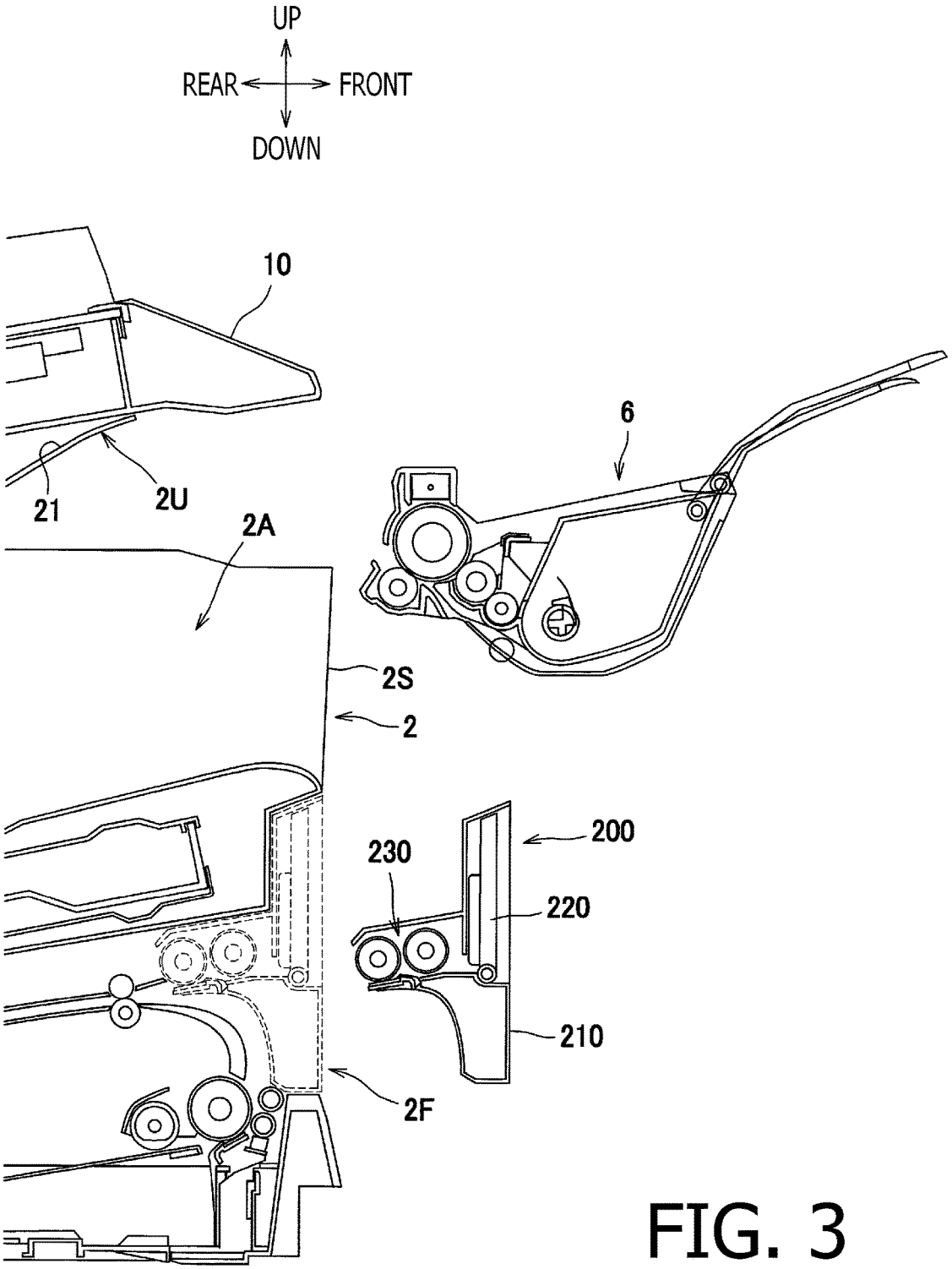
FIG. 3 is a partial view of the MFD according to the exemplary embodiment of the present disclosure with a processing cartridge and a manual-feeder tray being removed from a main chassis of the MFD.

As shown in FIG. 3, a part of the front wall 2F of the main chassis 2 forms a manual-feeder tray unit 200, which may be detachably attached to the main chassis 2. The manual-feeder tray unit 200 includes a base 210, which may be detachably attached to the main chassis 2, a manual-feeder tray 200, which is swingable with respect to the base 210, and a manual-feeder system 230, which may feed the sheet P manually placed on the manual-feeder tray 220 to the image forming unit 4. While the manual-feeder tray unit 200 is detachable from the main chassis 2, the sheet P which may be jammed in the vicinity of the manual-feeder tray unit 200 may be removed easily.

A printing operation to be conducted in the MFD 1 will be described below. Behaviors of the feeder unit 3 and the image forming unit 4 may be controlled by the controller 100 in a known method. Therefore, description of those are herein omitted.

As shown in FIG. 1, when, for example, an image is to be formed on a single side of the sheet P in the A4 size, a user may set the feeder tray 31A for the A4 size in the main chassis 2 and input a print command to the controller 100 through, for example, a personal computer (not shown) connected with the MFD 1. The controller 100, upon receiving the print command, places the switch member 110 in the first guiding position, which is indicated by the solid lines in FIG. 1, and drives the discharge roller 82 to rotate in the normal direction. The sheet P in the feeder tray 31A is conveyed to the image forming unit 4 to have an image printed on one side thereof. The sheet P is further guided to the first discharge path 81 by the switch member 110 and discharged on the discharge tray 21.

When, for another example, double-face printing is performed, i.e., when images are to be formed on both sides of the sheet P, the controller 100, upon receipt of the print command, places the switch 100 in the second guiding position, which is indicated by the broken lines in FIG. 1. Further, the controller 100 places the L-shaped guide 93 in the guiding position (FIG. 1) and drives the switchback roller 92 to rotate in the normal direction. The sheet P in the feeder tray 31A is conveyed to the image forming unit 4 to have an image printed on one side thereof and is guided by the switch member 110 to the second discharge path 91. The sheet P is conveyed in the second discharge path 91 to reach the switchback roller 92. Thereafter, the sheet P is conveyed upward by the switchback roller 92 and is bent frontward by the L-shaped guide 93 to be guided toward the switchback tray 22. In this regard, the sheet P exposed on the switchback tray 22 may be restricted at the widthwise ends thereof by the lateral frames 2S from skewing on the switchback tray 22.

Thereafter, before the sheet P exits the switchback roller 92, the controller 110 drives the switchback roller 92 to rotate in the reverse direction. Thereby, the sheet P is guided by the lateral frames 2S at the widthwise ends thereof while being drawn back in the main chassis 2 and conveyed toward the duplex conveyer path 121.

Thereafter, after the sheet P exits the switchback roller 92, the controller 100 drives the switchback roller 92 to rotate in the normal direction. Thereby, the sheet P conveyed through the duplex conveyer path 121 returns to the image forming unit 4, in which another image is printed on the other side thereof. Thereafter, the sheet P is conveyed through the second discharge path 91 to the switchback tray 22.

As shown in FIG. 4, when, for example, an image is to be formed on a single side of a sheet P2 in the A3 size, a user may set the feeder tray 31B for the A3 size in the main chassis 2 and input a print command to the controller 100 through, for example, the personal computer. The controller 100, upon receiving the print command, places the switch member 110 in the second guiding position, which is indicated by the broken lines in FIG. 4, and drives the switchback roller 92 to rotate in the normal direction. The sheet P2 in the feeder tray 31B is conveyed to the image forming unit 4 to have an image printed on one side thereof. The sheet P2 is further guided to the second discharge path 91 by the switch member 110. The sheet P2 is conveyed in the second discharge path 91 to reach the switchback roller 92. Thereafter, the sheet P2 is conveyed upward by the switchback roller 92 and is bent frontward by the L-shaped guide 93 to be guided toward the switchback tray 22.

When, for another example, double-face printing is performed, i.e., when images are to be formed on both sides of an A3-sized sheet, a front end of the sheet being conveyed to the switchback tray 22 may touch a desktop, a floor, or a plane, on which the MFD 1 is placed, and may be tainted. Meanwhile, according to the present embodiment, when images are to be printed on both sides of the A3-sized sheet P2, as shown in FIG. 4, the rotating direction of the switchback roller 92 is switched to the reverse direction before the front end of the sheet P2 may reach the desktop. Therefore, the sheet P2 may be prevented from being ruined.

For another example, when an image is to be printed on a single side of a sheet P3, which is a postcard size and may be thicker than the sheet P, the user may pull down the manual-feeder tray 220 to open. The user may place the sheet P3 on the manual-feeder tray 220 and input a print command to the controller 100 through, for example, the personal computer. The controller 100, upon receiving the print command, places the switch member 110 in the second guiding position, which is indicated by the broken lines in FIG. 4, and places the L-shaped guide 93 in the non-guiding position, which is indicated by broken lines in FIG. 4. Further, the controller 100 drives the switchback roller 92 to rotate in the normal direction. The sheet P3 in the manual-feeder tray 220 is conveyed to the image forming unit 4 to have an image printed on one side thereof and is guided by the switch member 110 to the second discharge path 91. The sheet P3 is conveyed in the second discharge path 91 to reach the switchback roller 92. Thereafter, the sheet P3 is conveyed upward by the switchback roller 92 to be discharged in the upper discharge tray 23. In this regard, the route for the sheet P3 to be conveyed from the manual-feeder tray 220 to the upper discharge tray 23 does not contain a curve with the smaller curvature radius. Therefore, the thicker sheet P3 may be prevented from being bent or damaged in the conveyer path.

Meanwhile, the method to print images on the sheets may not necessarily be limited to those described above. For example, when double-face printing is conducted to the sheet P, the L-shaped guide 93 may be placed in the non-guiding position so that the sheet P during switchback may be supported by the upper discharge tray 23 rather than the switchback tray 22. For another example, the sheet P during switchback may be supported by either the switchback tray 22 or the upper discharge tray 23, and thereafter, the switch member 110 may be placed in the first guiding position so that the sheet P with the images printed on both sides thereof may be discharged on the discharge tray 21.

According to the embodiment described above, the positions of the widthwise ends of the sheet P supported by the switchback tray 22 during switchback may be restricted by the lateral frames 2S. Therefore, regardless of the length of the sheet P, the sheet P may be restrained from skewing in the widthwise direction, and the sheet P may be switched back stably.

According to the embodiment described above, further, the reader unit 10 is disposed in the upper position with respect to the switchback tray 22 and supported by the lateral frames 2S. Therefore, the sheet P during switchback may be concealed by the reader unit 10 from the user's sight, and, for example, the sheet P may be prevented from being erroneously touched or grabbed by the user during the switchback. Further, it may be prevented that the user might place an obstacle on the switchback tray 22 and that the sheet P during the switchback may be caught or jammed by the obstacle.

According to the embodiment described above, further, the L-shaped guide 93 is arranged to overlap the lateral frames 2S in a view along the widthwise direction of the sheet P. Therefore, while the surface of the sheet P is guided by the L-shaped guide 93, the widthwise ends of the sheet P may be guided by the lateral frames 2S.

According to the embodiment described above, further, the aperture AP is formed by the sheet guide R7, which connects the reader unit 10 and the switchback tray 22 with each other. Therefore, the air may flow in the position between the reader unit 10 and the switchback tray 22, and the sheet P being switched back may be cooled down while being supported on the switchback tray 22.

According to the embodiment described above, further, the sheet P conveyed upward by the switchback roller 92 may be supported by the upper discharge tray 23 in the vertical posture, and the sheet P may be taken out of the upper discharge tray 23 by the user from above. Thus, the sheet P may be retrieved by the user easily. In this regard, as shown in FIG. 4, the user may visually recognize the sheet P discharged in the upper discharge tray 23 from the front.

According to the embodiment described above, further, the upper portion of the upper discharge tray 23 inclines frontward. Therefore, the sheet P being supported by the upper discharge tray 23 may lean frontward, and the user may reach the sheet P to retrieve more easily.

According to the embodiment described above, further, the upper discharge tray 23 is formed to have the plurality of slits R6, in which the guiding parts 93D in the comb-teeth arrangement in the L-shaped guide 93 may be inserted. Therefore, the upper discharge tray 23 may be placed to be closer to the switchback roller 92, and the sheet P may be conveyed from the switchback roller 92 to the upper discharge tray 23 smoothly.

Next, an example of a printer 300 (see FIGS. 8 and 9), which is not equipped with the reader unit 10, will be described. In the following example, items or structures which are the same as or similar to the items or the structures described in the previous embodiment will be referred to by the same reference signs, and description of those will be omitted.

In the printer 300, the lateral frames 2S, which may support the reader unit 10, are replaced with lateral frames SF. Each lateral frame SF may include a wall SF1, which protrudes upward from an upper surface of the lateral frame SF. The wall SF1 may restrict the sheet P being switched back from skewing.

According to the printer 300 without the reader unit 10, it may be possible for the user to place an obstacle, e.g., a book, on the switchback tray 22. However, the book may be held by the L-shaped guide 93 and upper edges of the walls SL1 in a position to be floating apart from the switchback tray 22. In other words, the L-shaped guide 93 and the walls SF1 may serve as a spacer, and the obstacle may not interfere with the sheet being switched back.

Figure 8:
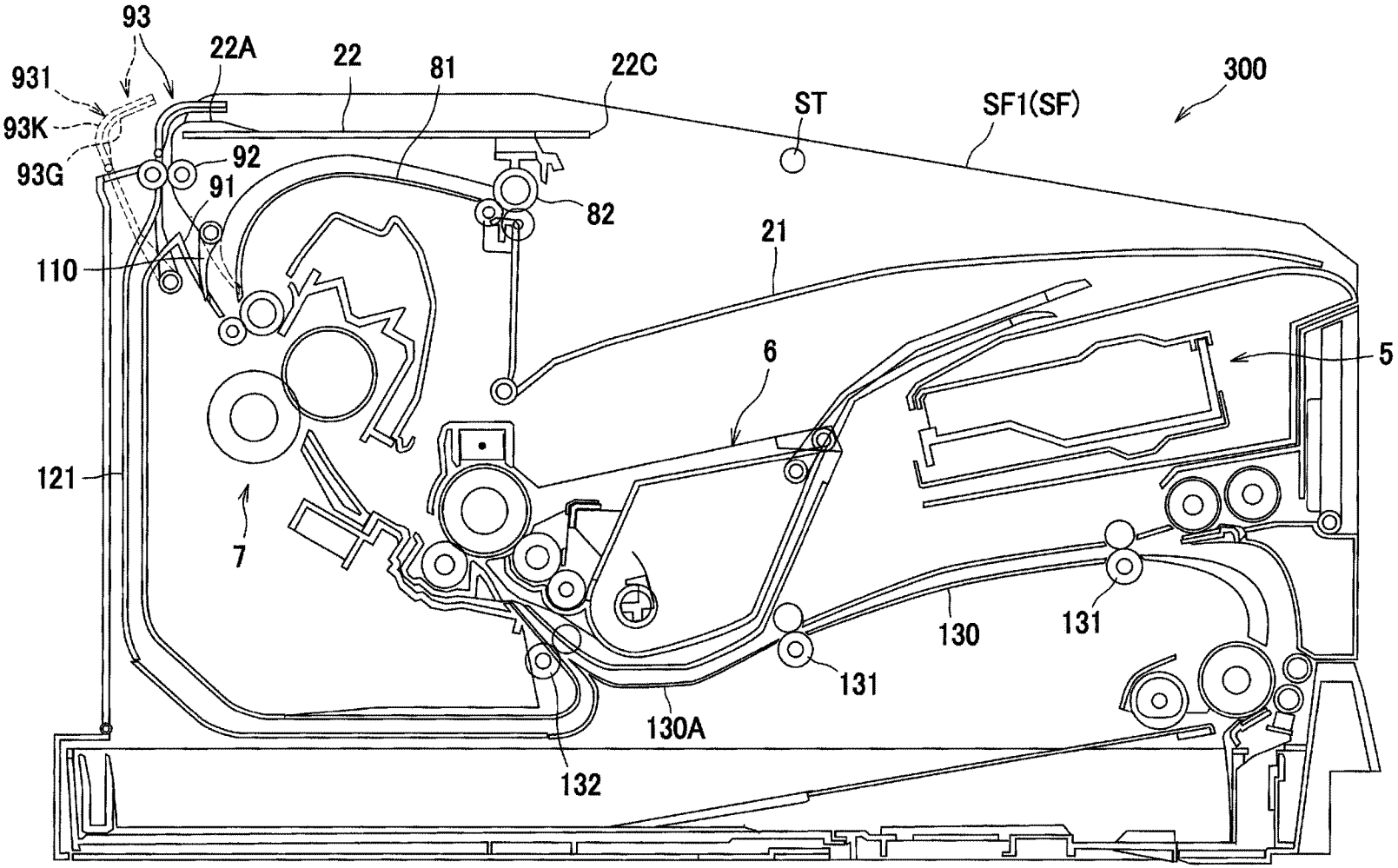
FIG. 8 is a cross-sectional side view of a modified example of the MFD according to the exemplary embodiment of the present disclosure.

According to the printer 300 shown in FIGS. 8 and 9, the upper discharge tray 23 may be omitted. If the upper discharge tray 23 is omitted, the L-shaped guide 93 may have a guiding part 931, which may replace the guiding parts 93D in the comb-teeth arrangement. The guiding part 931 may include an outer shell 93K, which is a plate extending in the widthwise direction, and a plurality of guide ribs 93G.

Although examples of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the inner surfaces S1 of the lateral frames S2 may not necessarily extend to the position to overlap the L-shaped guide 93 but may extend to reach at least the front end of the L-shaped guide 93, i.e., an exit for the sheet P formed between the L-shaped guide 93 and the switchback tray 22. With the inner surfaces S1 reaching the front side of the front end of the L-shaped guide 93, the sheet P supported on the switchback tray 22 may be restricted by the inner surfaces S1 from moving in the widthwise direction.

For another example, the second discharge unit 9 may not necessarily be equipped with the L-shaped guide 93 or the selectable two (2) trays 22, 23. The L-shaped guide 93 may be omitted so that the sheet P may be conveyed upward solely to the upper discharge tray 23, and/or an opening, through which the sheet P is conveyed to the switchback tray 22, may be covered so that the sheet P may be guided upward to the upper discharge tray 23 rather than the switchback tray 22.

For another example, the sheet P may not necessarily be paper, a postcard, or thinner paper, but may be, for example, an OHP sheet.

For another example, the front ends of the lateral frames 2S, i.e., the downstream ends of the lateral frames 2S with regard to the conveying direction for the sheet P to be conveyed to the switchback tray 22, may not necessarily be arranged at the same or close position as the front end of the discharge tray 21. However, in order to restrict the sheet P from moving in the widthwise direction, the front ends of the lateral frames 2S may be arranged on the same side as the discharge tray 21 with regard to the discharge roller.

What is claimed is:

1. An image forming apparatus, comprising:

a main chassis, comprising:

a first discharge portion including a first discharge tray, a first outlet, and a discharge roller configured to convey a recording sheet in a predetermined direction to discharge the recording sheet via the first outlet onto the first discharge tray, the first discharge tray extending in the predetermined direction, the predetermined direction being a direction including a horizontal component; and a second discharge portion including a second discharge tray and a second outlet, the second discharge portion being configured to discharge a recording sheet via the second outlet onto the second discharge tray, the second discharge tray extending in the predetermined direction, the second discharge tray being located at an upper position with respect to the first discharge tray, the second outlet being arranged in a different position from the first outlet with regard to the predetermined direction including the horizontal component, the second outlet being located at an upper position with respect to the first outlet;

a reading unit disposed above the first discharge portion and the second discharge portion, the reading unit being configured to read an image on a sheet and having a bottom surface, the reading unit being configured to pivot between a first position, in which the first discharge tray and the second discharge tray face the bottom surface of the reading unit, and a second position, in which the reading unit is farther away from the first discharge tray and the second discharge tray than the reading unit in the first position, the bottom surface being located at an upper position with respect to the first discharge tray and the second discharge tray; and an image forming unit configured to form an image on the recording sheet.

2. The image forming apparatus according to claim 1, further comprising:

a duplex conveyer comprising a switchback roller, the switchback roller being configured to be rotatable in a normal direction and a reverse direction, the switchback roller being configured to convey the recording sheet conveyed through the image forming unit toward the second discharge tray by rotating in the normal direction and to convey the recording sheet being conveyed toward the second discharge tray to return to the image forming unit by rotating in the reverse direction, the duplex conveyer being configured to invert the recording sheet conveyed through the image forming unit and convey the inverted recording sheet to return the image forming unit by switching rotation directions of the switchback roller.

3. The image forming apparatus according to claim 1, wherein the main chassis comprises a third discharge tray extending to an upper position with respect to the reading unit along a vertical direction at one side of the main chassis in the predetermined direction.

4. The image forming apparatus according to claim 3, wherein an upper part of the third discharge tray inclines with respect to the vertical direction toward another side of the main chassis opposite to the one side in the predetermined direction.

5. The image forming apparatus according to claim 3, wherein a minimum curvature radius in a route for the recording sheet to be conveyed to the third discharge tray is larger than a minimum curvature radius in a route for the sheet to be conveyed to the first discharge tray and than a minimum curvature radius in a route for the sheet to be conveyed to the second discharge tray.

6. The image forming apparatus according to claim 3, further comprises:

a first feeder tray arranged at a lower position in the main chassis; and a second feeder tray arranged at an upper position with respect to the first feeder tray on another side of the main chassis opposite to the one side in the predetermined direction, wherein a minimum curvature radius in a route for the recording sheet to be conveyed from the second feeder tray to the third discharge tray is larger than a minimum curvature radius in a route for the sheet to be conveyed from the first feeder tray to the first discharge tray and than a minimum curvature radius in a route for the sheet to be conveyed from the first feeder tray to the second discharge tray.

7. The image forming apparatus according to claim 3, wherein the main chassis comprises a wall at one end thereof on the one side in the predetermined direction, the wall extending in the vertical direction and in an orthogonal being orthogonal to the predetermined direction;

wherein the wall forms a part of the third discharge tray; and wherein the wall is pivotable at a lower end thereof about an axis extending in the orthogonal direction along with the third discharge tray.

8. The image forming apparatus according to claim 7, wherein the pair of walls support one end and the other end of the reading unit in an orthogonal direction being orthogonal to the predetermined direction.

9. The image forming apparatus according to claim 1, wherein the main chassis comprises a pair of walls, each of which extends in a vertical direction and in the predetermined direction; and wherein the first discharge tray and the second discharge tray are arranged between the pair of walls.

10. The image forming apparatus according to claim 1, wherein the first discharge tray is entirely positioned lower than the reading unit.

11. An image forming apparatus, comprising:

a main chassis, comprising:

a first discharge portion including a first discharge tray, a first outlet, and a discharge roller configured to convey a recording sheet in a predetermined direction to discharge the recording sheet via the first outlet onto the first discharge tray, the first discharge tray extending in the predetermined direction; and a second discharge portion including a second discharge tray and a second outlet, the second discharge portion being configured to discharge a recording sheet via the second outlet onto the second discharge tray, the second discharge tray extending in the predetermined direction, the second discharge tray being located at an upper position with respect to the first discharge tray, the second outlet being arranged in a different position from the first outlet with regard to the predetermined direction, the second outlet being located at an upper position with respect to the first outlet;

a reading unit disposed above the first discharge portion and the second discharge portion, the reading unit being configured to read an image on a sheet and having a bottom surface, the reading unit being configured to pivot between a first position, in which the first discharge tray and the second discharge tray face the bottom surface of the reading unit, and a second position, in which the reading unit is farther away from the first discharge tray and the second discharge tray than the reading unit in the first position, the bottom surface being located at an upper position with respect to the first discharge tray and the second discharge tray; and an image forming unit configured to form an image on the recording sheet;

wherein the main chassis comprises a pair of walls, each of which extends in a vertical direction and in the predetermined direction; and wherein the first discharge tray and the second discharge tray are arranged between the pair of walls.

* * * * *